US010373596B2

(12) United States Patent
Suzuki et al.

(10) Patent No.: US 10,373,596 B2
(45) Date of Patent: Aug. 6, 2019

(54) HAMMER DEVICE AND KEYBOARD DEVICE FOR ELECTRONIC KEYBOARD INSTRUMENT

(71) Applicant: KABUSHIKI KAISHA KAWAI GAKKI SEISAKUSHO, Hamamatsu-shi, Shizuoka-ken (JP)

(72) Inventors: Akihiro Suzuki, Hamamatsu (JP); Yoshiaki Shimoda, Hamamatsu (JP)

(73) Assignee: KABUSHIKI KAISHA KAWAI GAKKI SEISAKUSHO, Hamamatsu-shi, Shizuoka (JP)

( * ) Notice: Subject to any disclaimer, the term of this patent is extended or adjusted under 35 U.S.C. 154(b) by 0 days.

(21) Appl. No.: 15/924,018

(22) Filed: Mar. 16, 2018

(65) Prior Publication Data

US 2018/0277082 A1 Sep. 27, 2018

(30) Foreign Application Priority Data

Mar. 21, 2017 (JP) ..... 2017-054150
Mar. 21, 2017 (JP) ..... 2017-054151
Mar. 21, 2017 (JP) ..... 2017-054152

(51) Int. Cl.
*G10H 1/34* (2006.01)

(52) U.S. Cl.
CPC ..... *G10H 1/346* (2013.01)

(58) Field of Classification Search
CPC ..... G10H 1/346
See application file for complete search history.

(56) References Cited

U.S. PATENT DOCUMENTS 4,217,803 A * 8/1980 Dodds ..... G10H 1/346 200/277
4,273,017 A * 6/1981 Dodds ..... G10H 1/346 200/16 A
5,542,332 A * 8/1996 Tamai ..... G10H 1/344 84/251
5,574,241 A * 11/1996 Kumano ..... G10C 3/12 84/433
5,866,831 A * 2/1999 Kimble ..... G10H 1/346 84/433

(Continued)

FOREIGN PATENT DOCUMENTS

JP 2013-125236 6/2013

*Primary Examiner* — Robert W Horn
(74) *Attorney, Agent, or Firm* — Lewis Roca Rothgerber Christie LLP

(57) ABSTRACT

A keyboard device for an electronic keyboard instrument, making uniform an upper surface height of the rear end of each key in contact with a hammer in a key-released state. The keyboard device includes longitudinally extending wooden keys capable of swinging and laterally juxtaposed, a hammer support disposed rearward of the keys, longitudinally extending hammers having a rear end thereof supported by the hammer support vertically pivotally movably and a protrusion protruding downward from a lower surface thereof for contact with a rear end of an associated key, and hammer contact height-regulating parts each made of a synthetic resin and mounted on the rear end of each key, the part being in contact with the protrusion in the key-released state, to regulate a contact height of the protrusion to a predetermined height.

13 Claims, 11 Drawing Sheets

(56) References Cited

U.S. PATENT DOCUMENTS

| | | | | |
|---|---|---|---|---|
| 6,191,351 | B1 * | 2/2001 | Niitsuma | G10H 1/346 84/423 R |
| 6,365,820 | B1 * | 4/2002 | Kondo | G10H 1/346 84/21 |
| 6,653,542 | B2 * | 11/2003 | Suzuki | G10C 3/12 84/423 R |
| 6,765,142 | B2 * | 7/2004 | Sakurada | G10H 1/346 84/600 |
| 7,732,686 | B2 * | 6/2010 | Yamaguchi | G10H 1/346 84/236 |
| 7,858,863 | B2 * | 12/2010 | Osuga | G10H 1/346 84/423 R |
| 8,093,480 | B2 * | 1/2012 | Yoshida | G10H 1/346 84/439 |
| 8,766,075 | B2 * | 7/2014 | Ishida | G10H 1/34 84/423 R |
| 9,006,549 | B2 * | 4/2015 | Suzuki | G10H 1/34 84/423 R |
| 9,082,372 | B2 * | 7/2015 | Suzuki | G10C 3/12 |
| 2018/0277082 | A1 * | 9/2018 | Suzuki | G10H 1/346 |

* cited by examiner

HAMMER DEVICE AND KEYBOARD DEVICE FOR ELECTRONIC KEYBOARD INSTRUMENT

CROSS-REFERENCE TO RELATED APPLICATION(S)

This application claims priority of Japanese Patent Application Number 054150/2017, filed on Mar. 21, 2017, Japanese Patent Application Number 054151/2017, filed on Mar. 21, 2017, and Japanese Patent Application Number 054152/2017, filed on Mar. 21, 2017, the entire contents of all of which are incorporated herein by reference.

BACKGROUND OF THE INVENTION

Field of the Invention

The present invention relates to a hammer device and a keyboard device for an electronic keyboard instrument including a hammer which is applied to an electronic keyboard instrument, such as an electronic piano, and is configured to be pivotally moved by being pushed up by a depressed key.

Description of the Related Art

Conventionally, as the hammer device and keyboard device of the above-mentioned type, there have been known those disclosed e.g. in Japanese Laid-Open Patent Publication (Kokai) No. 2013-125236 filed by the present applicant. This keyboard device is provided with a plurality of keys each extending in the front-rear direction of the keyboard device and configured to be capable of swinging about a support located close to the longitudinal center of the key, and a plurality of hammers each extending in the front-rear direction, with its rear end supported such that the hammer can be pivotally moved in the vertical direction, and being in contact with a rear end of an associated one of the keys from above. Each of the keys is made of a wood material and has a rectangular shape in transverse cross-section.

On the other hand, the hammer device is comprised of a hammer support disposed rearward of the keys, and the hammers provided in association with the respective keys and pivotally supported by the hammer support. Each of the hammers is comprised of a hammer body formed by a molded article of a synthetic resin and extending in an arm shape in the front-rear direction, and weight plates made of metal and attached to the front ends of the respective left and right side surfaces of the hammer body. The hammer body has an arcuate shaft hole formed in the rear end thereof, and this shaft hole is pivotally engaged with a hammer support shaft extending in the left-right direction of the hammer support. Further, a capstan screw is screwed in the lower surface of the hammer body such that the capstan screw can be screwed in and out at a location immediately forward of the shaft hole, and each hammer is placed on an associated one of the keys with a head part of a lower end of the capstan screw held in contact with the rear end of the associated key from above.

In the keyboard device and the hammer device constructed as above, when in a key-released state, each key is held rearwardly and downwardly inclined with a rear end of its lower surface placed on a cushion, while each hammer is held in a state placed on the rear end of an associated one of the keys via the capstan screw. When key depression starts in this state, the key swings to have its front end lowered and its rear end raised, and the associated hammer pivotally moves upward by being pushed up by the key via the capstan screw. Then, when the key is fully depressed, the hammer is brought into abutment with a hammer stopper disposed above, whereby the upward pivotal motion of the hammer is terminated. Thereafter, when the key is released, it swings in the opposite direction to the direction in which it swung during the key depression, and in accordance with this swing of the key, the hammer also pivotally moves downward to return to its original key-released state.

The keys of the above-described keyboard device, each of which is made of wood, are liable to vary in vertical thickness due to manufacturing error or expansion/contraction caused by dryness/wetness in a use environment of an electronic keyboard instrument. Further, in the keyboard device of the above-described type, it is generally demanded that in the key-released state, the positions (postures) of the respective hammers, as viewed from the side of each hammer, are held uniform so as to make uniform the angles of pivotal motion of the hammers by key depression or make uniform key depression strokes as the amounts of key depression. For this reason, when keys vary in thickness, particularly in rear-end upper surface height, as mentioned above, the capstan screw of each hammer is turned to adjust the amount of projection thereof from the hammer body such that the positions of the respective hammers become uniform in the key-released state.

As described above, in the conventional keyboard device, it is required to screw a capstan screw into each hammer body during manufacturing operation, and the work for attaching capstan screws to the respective hammer bodies is complicated and troublesome. Further, it is required to adjust a capstan screw according to the height of the upper surface of the rear end of each key, and the adjustment work is also complicated and troublesome.

Further, in general in the above-described hammer device, a lubricant, such as grease, having high viscosity is applied between the hammer support shaft of the hammer support and the shaft hole of a hammer engaged with the hammer support shaft, whereby smooth pivotal motion of the hammer is ensured while preventing the hammer from causing rattling and noise during its pivotal motion.

However, there is a fear that the lubricant can spill out toward the capstan screw disposed forward, depending e.g. on a use environment of the electronic piano. Further, the viscosity of a lubricant already applied between the head part of the capstan screw and the associated key is relatively low, so that when the above-mentioned lubricant having high viscosity spills out and sticks to a lower end surface of the capstan screw, the difference between the two kinds of lubricants causes a change in lubricant characteristics and a resultant change in the friction between the head part of the capstan screw and the associated key. As a consequence, the pivoting characteristics of the hammer in key depression also change.

SUMMARY OF THE INVENTION

It is a first object of the present invention to provide a keyboard device for an electronic keyboard instrument, which makes it possible to make uniform the upper surface height of a rear end of each key with which a hammer is in contact in a key-released state even when rear ends of keys vary in vertical thickness, to thereby dispense with work for adjusting a conventional capstan screw.

It is a second object of the present invention to provide a hammer device for an electronic keyboard instrument, which makes it possible to omit a conventional capstan screw and dispense with work for mounting and adjusting the capstan screw, and thereby contributes to reduction of manufacturing costs of the electronic keyboard instrument.

It is a third object of the present invention to provide a hammer device for an electronic keyboard instrument, which is capable of preventing a lubricant applied to a pivoting portion of a hammer from spilling out between the hammer and an associated key, to thereby maintain excellent pivoting characteristics of the hammer in key depression.

To attain the above first object, in a first aspect of the present invention, there is provided a keyboard device for an electronic keyboard instrument, comprising a plurality of keys made of wood, each extending in a front-rear direction and configured to be capable of swinging about a support close to a center thereof in the front-rear direction, the keys being arranged in a state juxtaposed in a left-right direction, a hammer support disposed rearward of the keys, a plurality of hammers each extending in the front-rear direction, the hammers each having a rear end thereof supported by the hammer support pivotally movably in a vertical direction, and a protrusion protruding downward from a lower surface thereof brought into contact with a rear end of an associated one of the keys, and a plurality of hammer contact height-regulating parts each made of a synthetic resin and mounted on the rear end of each of the keys, the hammer contact height-regulating part being in contact with the protrusion of an associated one of the hammers in a key-released state, to regulate a contact height of the protrusion to a predetermined height.

With this arrangement of the keyboard device, the keys each extending in the front-rear direction and configured to be capable of swinging about the support close to the center thereof are arranged in the state juxtaposed in the left-right direction. Further, each of the hammers each extending in the front-rear direction has the rear end thereof supported by the hammer support pivotally movably in the vertical direction, and the protrusion protruding downward from the lower surface of the hammer is brought into contact with the hammer contact height-regulating part which is made of a synthetic resin and is mounted on the rear end of the associated key. In this state, when the key is depressed, the hammer is pushed up by the key via the protrusion, and is thereby pivotally moved upward. Each key is made of wood and hence is liable to vary in vertical thickness due to manufacturing error or expansion/contraction caused by dryness/wetness. However, by mounting the hammer contact height-regulating part of a synthetic resin, which can be manufactured with a high degree of precision and is hardly affected by dryness/wetness, on the rear end of each key, it is possible to set the upper surface of the rear end of each key, with which the protrusion of the hammer is in contact, at a uniform height. This makes it unnecessary to adjust the protrusion of the hammer, differently from the prior art. Therefore, even if the protrusion of the hammer is formed by a capstan screw, work for adjusting the capstan screw can be dispensed with.

Preferably, the keyboard device further comprises a regulating part-receiving member which is disposed to extend in the left-right direction in association with the keys, and on which the hammer contact height-regulating parts are placed at the same height in a key-released state.

With the arrangement of this preferred embodiment, the regulating part-receiving member is disposed to extend in the left-right direction in association with the keys juxtaposed in the left-right direction, and in the key-released state, the hammer contact height-regulating parts mounted on the rear ends of the respective keys are placed on the regulating part-receiving member. In this case, even when the rear ends of the respective keys vary in thickness, the height of the upper surface of the hammer contact height-regulating part in the key-released state is determined by a state of the hammer contact height-regulating part placed on the regulating part-receiving member. Therefore, by mounting the hammer contact height-regulating part on the rear end of each of the keys, it is possible to set all the hammer contact height-regulating parts at the same height while accommodating thickness variations in the rear ends of the respective keys.

More preferably, the hammer contact height-regulating part includes an upper piece secured to an upper surface of the key and held in contact with the protrusion of the hammer, and a rear piece extending downward continuously from an rear end of the upper piece and secured to a rear surface of the key.

With the arrangement of this preferred embodiment, the upper piece and the rear piece of the hammer contact height-regulating part are secured to the respective upper and rear surfaces of the key, so that even when the vertical thickness of the rear end of the key changes e.g. due to dryness/wetness, it is possible to avoid an external force generated by the change from acting on the hammer contact height-regulating part.

Further preferably, the hammer contact height-regulating part further includes a side wall continuous with respective sides of the upper piece and the rear piece and held in intimate contact with a side surface of the key.

With the arrangement of this preferred embodiment, by mounting the hammer contact height-regulating part on the key in a state in which the upper piece, the rear piece, and the side wall are in intimate contact with the upper, rear, and side surfaces of the rear end of the key, respectively, it is possible to ensure accurate mounting of the hammer contact height-regulating part on the key.

Further preferably, the hammer contact height-regulating part further includes a lower piece extending forward from a lower end of the rear piece and being in contact with a lower surface of the key.

With the arrangement of this preferred embodiment, the hammer contact height-regulating part is mounted on the key by vertically sandwiching the rear end of the key with the upper piece and the lower piece of the hammer contact height-regulating part, so that it is possible to efficiently carry out the work for mounting the hammer contact height-regulating part on the key.

Further preferably, each of the upper piece and the rear piece of the hammer contact height-regulating part is secured to the key via a bracket.

With the arrangement of this preferred embodiment, the upper piece and the rear piece of the hammer contact height-regulating part are firmly secured to the upper and rear surfaces of the rear end of the key via the brackets, respectively. This makes it possible to accurately maintain height of contact between the protrusion of the hammer and the key in the key-released state, without misalignment between the hammer contact height-regulating part and the key, even when reaction force from the hammer pushed up by key depression repeatedly acts on the hammer contact height-regulating part.

To attain the above second object, in a second aspect of the present invention, there is provided a hammer device for an electronic keyboard instrument including a key extending in a front-rear direction and configured to be capable of swinging about a portion close to a center thereof, wherein the hammer device includes a hammer which is placed on a rear end of the key and pivotally moves by being pushed up by the key when the key is depressed, the hammer device comprising a hammer body made of a synthetic resin, which extends in the front-rear direction and is supported such that the hammer body is pivotally movable in a vertical direction about a support in a rear end thereof, and a contact protrusion integrally formed with the hammer body at a predetermined location forward of the support of the hammer body in a state protruding downward, the contract protrusion being in contact with the rear end of the key from above in a key-released state.

With this arrangement of the hammer device, the hammer body is made of a synthetic resin, and the downwardly protruding contact protrusion is integrally formed with the hammer body at the predetermined location forward of the support in the rear end of the hammer body. The contact protrusion of the hammer body is in contact with the rear end of the key from above in the key-released state. In this state, when the key swings, by being depressed, such that the front end thereof is lowered and the rear end thereof is raised, the hammer associated with the key is pushed up by the key via the contact protrusion and is thereby pivotally moved upward about the support in the rear end.

In this case, the upper surface of the rear end the key in contact with the contact protrusion of the hammer is held at a fixed height in the key-released state, whereby it is possible to use the contact protrusion in place of the conventional capstan screw, for pushing up the hammer by the key. Therefore, according to the present invention, the conventional capstan screw can be omitted, which makes it possible to dispense with work for mounting and adjusting the capstan screw, and contributes to reduction of the manufacturing costs of the electronic keyboard instrument.

Preferably, the hammer device further comprises a protrusion cover made of a predetermined elastic material and mounted on the hammer body in a state covering the contact protrusion.

With the arrangement of this preferred embodiment, the protrusion cover made of an elastic material is mounted on the hammer body in a state covering the contact protrusion. Therefore, in comparison with a case where the contact protrusion made e.g. of a hard synthetic resin is directly brought into contact with the key when the key is depressed, or is brought into contact with the same again after temporarily moving away from the key, or slides over the key, it is possible to considerably reduce noise generated by the contact between the contact protrusion and the key.

More preferably, the protrusion cover includes a cover body which opens upward and accommodates the contact protrusion, and a hook provided such that the hook protrudes upward from the cover body, and the hammer body has a hook-receiving part formed in a recessed shape opening downward for engagement with the hook in a state preventing the hook from coming off.

With the arrangement of this preferred embodiment, the protrusion cover includes the cover body and the hook, and in a state mounted on the contact protrusion of the hammer, the cover body accommodates the contact protrusion, with the hook being engaged with the hook-receiving part formed in the recessed shape opening downward, such that the hook is prevented from coming off. With this, the protrusion cover is securely mounted on the hammer body, so that even when the hammer is repeatedly pushed up in accordance with key depression, the protrusion cover does not come off the contact protrusion of the hammer. Further, the protrusion cover can be easily removed from the hammer body by disengaging the hook of the protrusion cover from the hook-receiving part, which makes it possible to easily replace the protrusion cover with a new one as required.

Further preferably, the hook-receiving part is formed in the hammer body at a predetermined location forward of the contact protrusion.

With the arrangement of this preferred embodiment, the hook-receiving part formed in the recessed shape opening downward is provided at the predetermined location forward of the contact protrusion of the hammer body, i.e. at a location away from the support in the rear end of the hammer body. With this, in comparison with a case where the hook-receiving part is provided e.g. at a location rearward of the contact protrusion of the hammer, i.e. at a location closer to the support in the rear end of the hammer body, it is possible to reduce reaction force acting on a portion of the hammer body in the vicinity of the base part of the contact protrusion of the hammer body during key depression. As a consequence, even when the hammer is repeatedly pushed up in accordance with key depression, it is possible to prevent the hammer (hammer body) from being damaged.

To attain the above third object, in a third aspect of the present invention, there is provided a hammer device for an electronic keyboard instrument including a key extending in a front-rear direction and configured to be capable of swinging about a portion close to a center thereof, wherein the hammer device includes a hammer which is placed on a rear end of the key and pivotally moves by being pushed up by the key when the key is depressed, the hammer device comprising a hammer support disposed rearward of the key, a hammer body made of a synthetic resin, which extends in the front-rear direction and has an engaging part of a rear end thereof being engaged with the hammer support, thereby being supported thereon pivotally movably in a vertical direction, a key contact part provided on the hammer body at a predetermined location forward of the engaging part such that the key contact part protrudes downward, the key contact part being in contact with the rear end of the key from above in a key-released state, and a lubricant-blocking portion provided in a side surface of the hammer body so as to prevent a lubricant applied to the engaging part from spilling out to the key contact part.

With this arrangement of the hammer device, the hammer body extending in the front-rear direction is engaged with the hammer support disposed rearward of the key via the engaging part formed in the rear end thereof, thereby being supported on the hammer support pivotally movably in the vertical direction. Further, the hammer body is made of a synthetic resin, and the key contact part formed on the hammer body at the predetermined location forward of the engaging part such that the key contact part protrudes downward is in contact with the rear end of the key from above in the key-released state. When the key is depressed in this state, the hammer is pushed up by the key via the key contact part and is thereby pivotally moved upward.

In general, as described hereinbefore, a lubricant, such as grease, is applied to the engaging part of the hammer for engagement with the hammer support so as to prevent the hammer from causing rattling and noise during the pivotal motion thereof. The side surface of the hammer body is formed with the lubricant-blocking portion, and the lubricant-blocking portion makes it possible to prevent the lubricant from spilling out to the key contact part. With this, it is possible to prevent the friction between the key contact part of the hammer and the key from being changed, and as a consequence, it is possible to maintain excellent pivoting characteristics of the hammer during key depression.

Preferably, the lubricant-blocking portion is formed in an arcuate shape surrounding the engaging part.

With the arrangement of this preferred embodiment, the lubricant-blocking portion provided in the side surface of the hammer body is formed in the arcuate shape surrounding the engaging part in engagement with the hammer support. Therefore, even in a case where the lubricant spills out from the engaging part, it is possible to effectively prevent the lubricant from flowing around the lubricant-blocking portion.

More preferably, the lubricant-blocking portion is formed in a recessed shape opening in a lateral direction of the hammer body.

With the arrangement of this preferred embodiment, the lubricant-blocking portion provided in the side surface of the hammer body is formed in the recessed shape opening in the lateral direction of the hammer body. Therefore, even in a case where the lubricant having spilled out from the engaging part flows along the side surface of the hammer body, it is possible to effectively prevent the lubricant from crossing over the lubricant-blocking portion formed in the recessed shape. In addition, in comparison with a case where the lubricant-blocking portion is formed in a convex shape protruding in the lateral direction, it is possible not only to reduce the amount of synthetic resin required for manufacturing the hammer body, but also to avoid interference between hammers disposed adjacent to each other.

The above and other objects, features, and advantages of the present invention will become more apparent from the following detailed description taken in conjunction with the accompanying drawings.

BRIEF DESCRIPTION OF THE DRAWINGS

FIGS. 4A and 4B are perspective views of part of the keyframe front, as viewed from a bottom surface side, in which FIG. 4A shows a state in which two keyframe-front moldings have been connected to each other, and FIG. 4B shows a state in which the tow keyframe-front moldings have not been connected to each other yet.

FIGS. 5A to 5F are schematic views useful in explaining changes in the distance between pin holes, which are caused by expansion/contraction due to dryness/wetness in the state in which the two keyframe-front moldings have been connected to each other, in which FIGS. 5A to 5C show the keyframe-front moldings used in the present embodiment, and FIGS. 5D to 5F show keyframe-front moldings used in a comparative example.

FIGS. 12A to 12C are views useful in explaining a hammer and a protrusion cover to be mounted on a contact protrusion of the hammer, in which FIG. 12A is a side view of the hammer, FIG. 12B is a cross-sectional view taken by vertically cutting a portion of the hammer including the contact protrusion and the protrusion cover, and FIG. 12C is a perspective view of the protrusion cover.

FIGS. 13A to 13C are views useful in explaining a posture of the hammer in a key-released state, in which FIG. 13A shows the black key-associated hammer, FIG. 13B shows the white key-associated hammer, and FIG. 13C shows an engaging part in a rear end of the black key-associated and white key-associated hammers on an enlarged scale.

FIGS. 14A and 14B are views useful in explaining how the hammer is removed from the hammer support, in which FIG. 14A shows the black key-associated hammer, and FIG. 14B shows the white key-associated hammer.

DETAILED DESCRIPTION OF PREFERRED EMBODIMENTS

Figure 1:
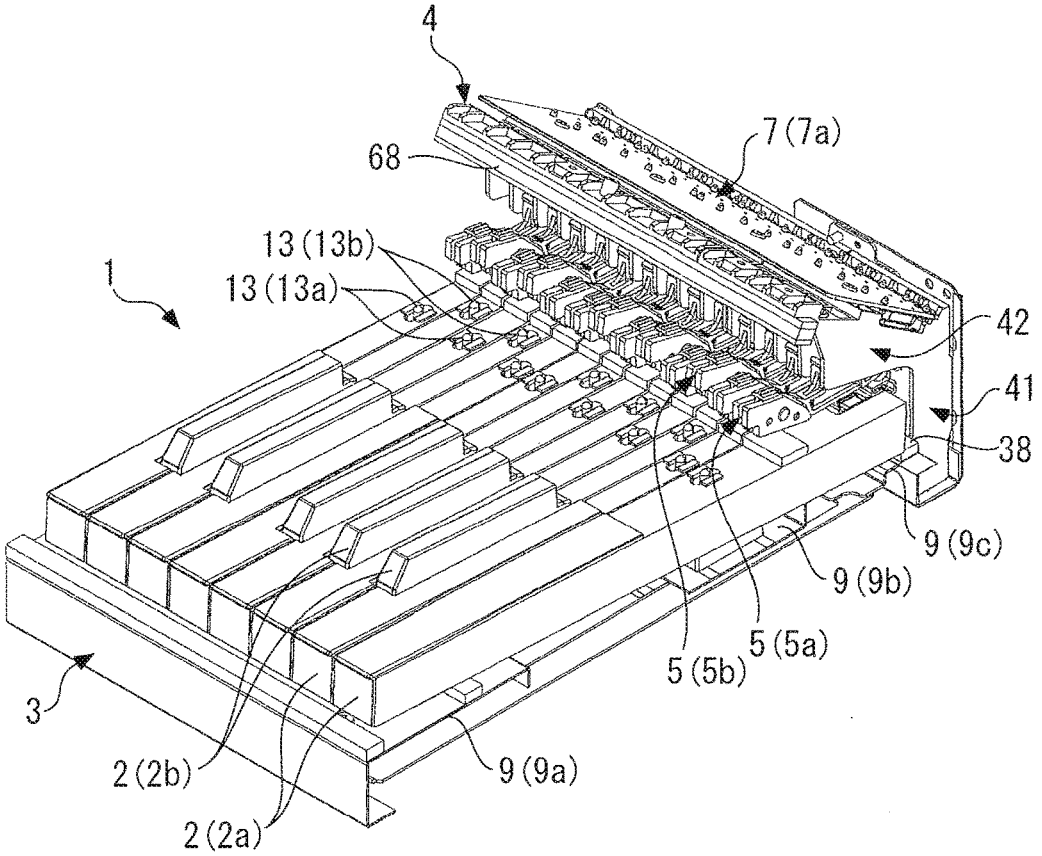
FIG. 1 is a perspective view of a part (one octave section) of a keyboard device for an electronic piano to which is applied a keyboard device according to an embodiment of the present invention.
Figure 2:
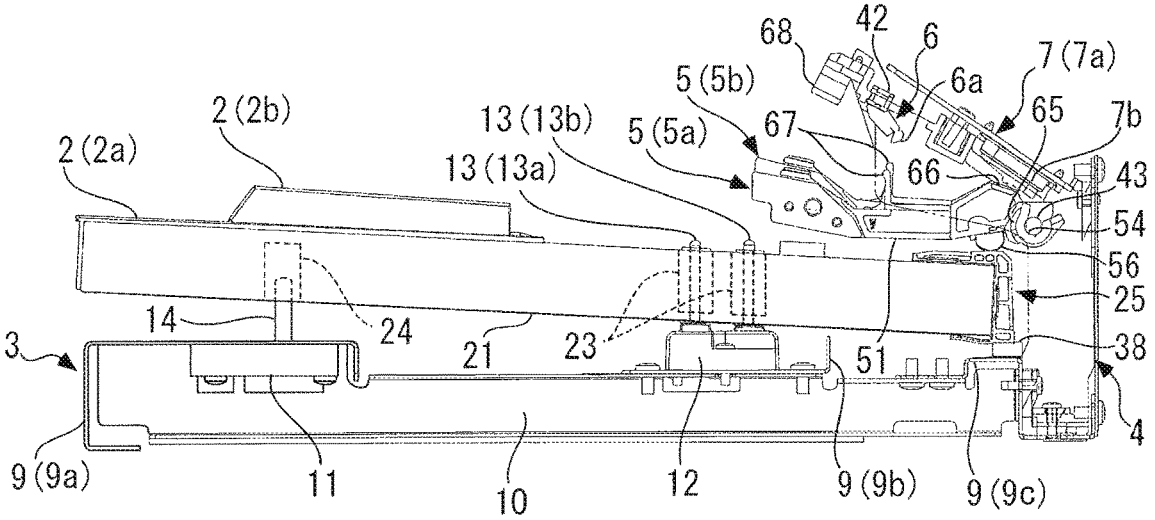
FIG. 2 is a side view of the keyboard device shown in FIG. 1.

The present invention will now be described in detail with reference to the drawings showing a preferred embodiment thereof. FIGS. 1 and 2 partially show an electronic piano to which are applied a keyboard device and a hammer device according to an embodiment of the present invention, and the electronic piano is shown in a key-released state. As shown in FIGS. 1 and 2, the keyboard device 1 includes a plurality of keys 2 (of which only eight white keys 2*a* and five black keys 2*b* are shown in FIG. 1) juxtaposed in a left-right direction of the electronic piano, a keyboard chassis 3 for supporting the keys 2, a hammer support 4 connected to a rear end of the keyboard chassis 3, a plurality of hammers 5 (of which only eight white key-associated hammers 5*a* and five black key-associated hammers 5*b* are shown in FIG. 1), each of which is provided for an associated one of the keys 2 and pivotally moves in accordance with depression of the key 2, a plurality of let-off members 6 (only one of which is shown in FIG. 2), each of which is provided for an associated one of the hammers 5 so as to add let-off feeling to the touch feeling of the associated key 2 during depression of the key 2, and a key switch 7 for detecting key depression information of each key 2.

The keyboard chassis 3 is formed by assembling three support rails 9, i.e. a front rail 9*a*, a center rail 9*b*, and a rear rail 9*c* each extending in the left-right direction, and a plurality of reinforcement ribs 10 extending in the front-rear direction, in parallel crosses, and is secured to a keybed (not shown). Each of the support rails 9 and the ribs 10 is made of a metal plate formed into a predetermined shape by press-punching and press-bending.

A keyframe front 11 is secured to the lower surface of the front rail 9*a*, and a keyframe center 12 is secured to the upper surface of the center rail 9*b*, The keyframe front 11 and the keyframe center 12 each formed as a thick flat plate member made of a synthetic resin (e.g. an ABS resin) extend in the left-right direction along the entire front rail 9*a* and the entire center rail 9*b*, respectively. On the keyframe center 12, a large number of balance pins 13 (of which only eight white key-associated balance pins 13*a* and five black key-associated balance pins 13*b* are shown in FIG. 1) are erected at respective front and rear locations corresponding to the white keys 2*a* and the black keys 2*b*, respectively, in a state juxtaposed in the left-right direction. Further, on the keyframe front 11, a large number of front pins 14 are erected in a state juxtaposed in the left-right direction.

Figure 3:
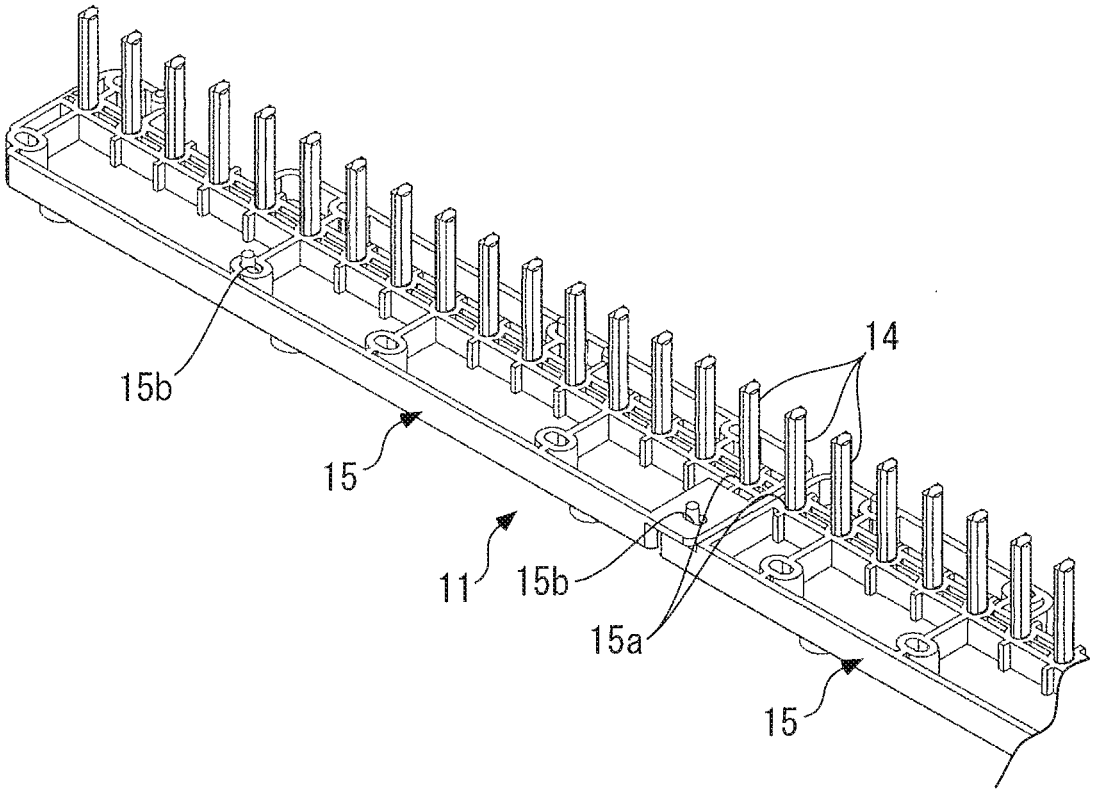
FIG. 3 is a perspective view of part of a keyframe front and front pins.

FIG. 3 partially shows the keyframe front 11 having the front pins 14 erected thereon. As shown in FIG. 3, the keyframe front 11 is formed by connecting a plurality of (e.g. two to five) molded articles 15 (hereinafter each referred to "the keyframe-front molding 15") each extending in the left-right direction, to each other in the left-right direction. Each of the keyframe-front moldings 15 is formed with a plurality of pin holes 15*a* arranged in its longitudinal direction for having the lower ends of the respective front pins 14 fitted therein, and a plurality of mounting holes 15*b* for use in fastening the keyframe-front molding 15 itself to the front rail 9*a* with screws. Each of the mounting holes 15*b* is formed into a slot shape extending in the longitudinal (left-right) direction of the keyframe-front molding 15. The keyframe-front moldings 15 and 15 adjacent to each other are connected as described below.

Figure 4A:
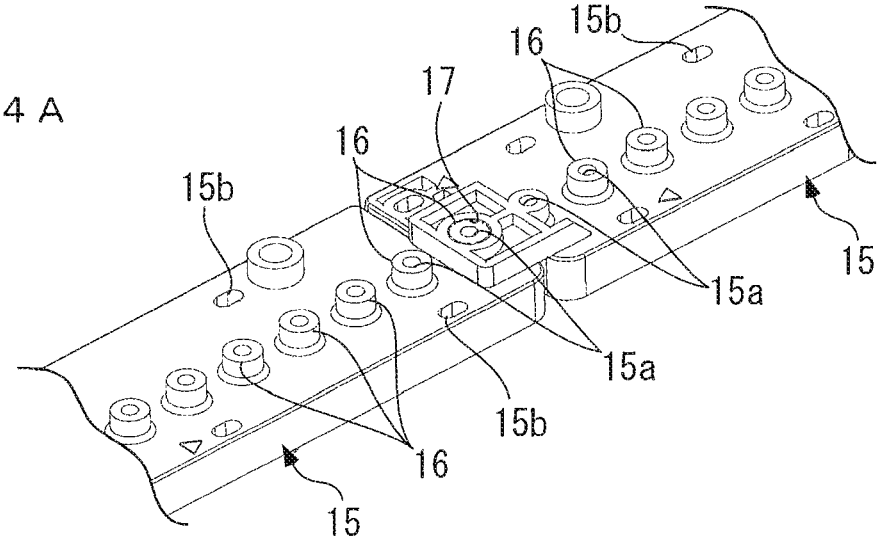
Figure 4B:
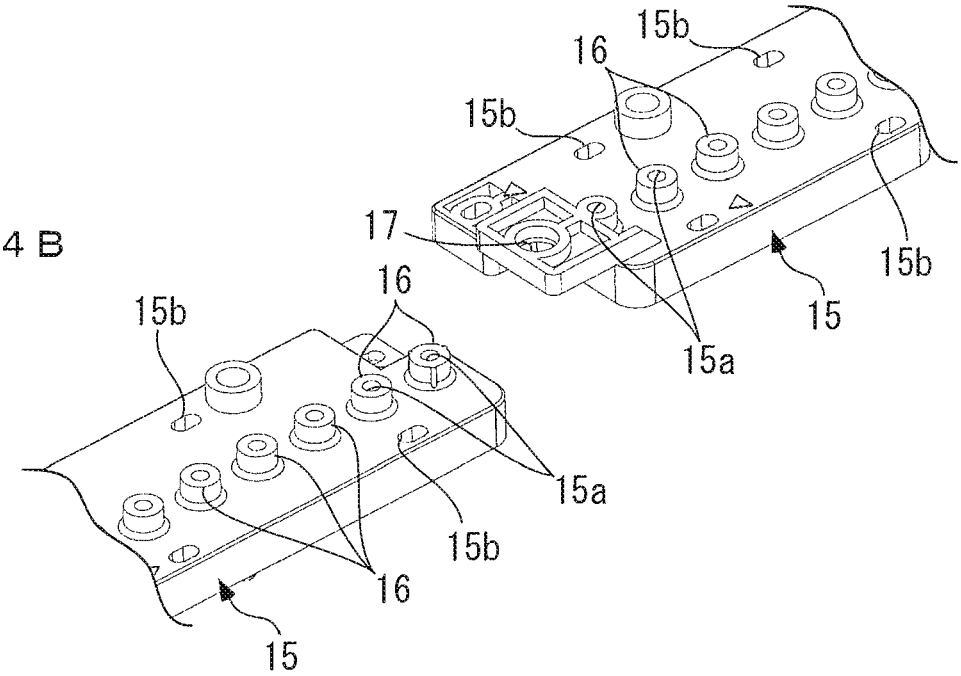

FIGS. 4A and 4B show a connection part between the two keyframe-front moldings 15 and 15, as viewed from a bottom surface side. FIG. 4A shows a state in which the keyframe-front moldings 15 and 15 have been connected to each other, and FIG. 4B show a state in which the keyframe-front moldings 15 and 15 have not been connected yet. As shown in FIGS. 4A and 4B, each of the keyframe-front moldings 15 and 15 has a large number of bosses 16 formed on a bottom surface thereof in association with the large number of pin holes 15*a*, respectively. Each boss 16 has a predetermined diameter and protrudes downward (upward, as viewed in FIGS. 4A and 4B). Further, one (right one, as viewed in FIG. 4B) of the keyframe-front moldings 15 has a fitting hole 17 formed in an end (left end, as viewed in FIG. 4B) thereof, for having a boss 16 on an end (right end, as viewed in FIG. 4B) of the other keyframe-front molding 15 (left one, as viewed in FIG. 4B) fitted therein.

The keyframe front 11, which is formed by connecting the keyframe-front moldings 15 made of a synthetic resin to each other, as described above, can expand or contract in its longitudinal direction (left-right direction) e.g. due to a change in temperature under a use environment of the electronic piano. In this case, the amount of change in the keyframe front 11 made of the synthetic resin is larger than that in the front rail 9*a* made of metal, and the above-described connection structure of the keyframe-front moldings 15 makes it possible to suppress change in the distance between the pin holes 15*a* and 15*a* of the keyframe-front moldings 15 and 15 adjacent to each other, as described below.

Figure 5A:
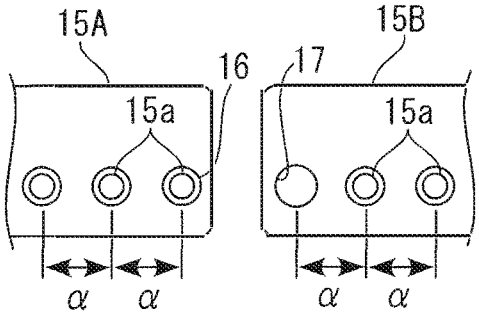
Figure 5D:
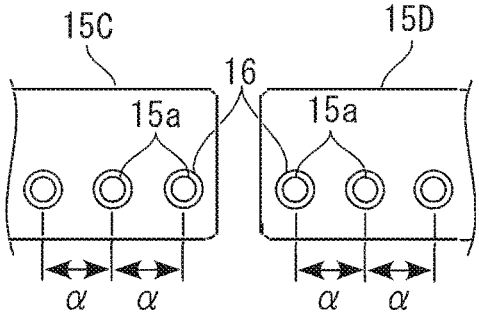
Figure 5B:
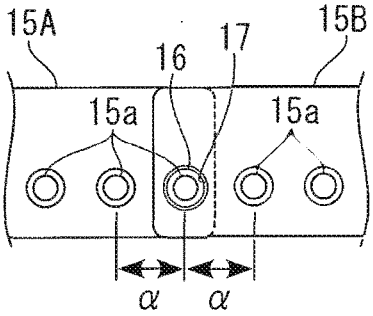
Figure 5E:
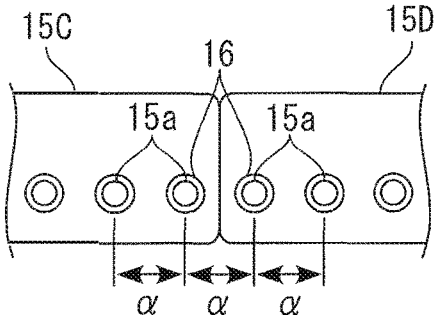
Figure 5C:
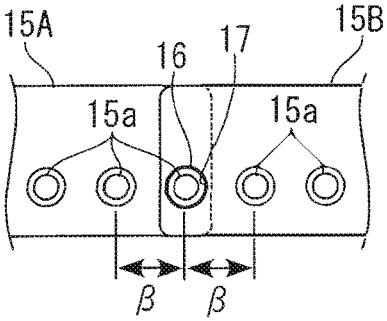

FIGS. 5A to 5C schematically show contraction of the keyframe front 11 in a state in which keyframe-front moldings 15A and 15B in the present embodiment have been connected to each other and fastened to the front rail 9*a* with screws. As described hereinbefore, the two keyframe-front moldings 15A and 15B shown in FIG. 5A are connected to each other with the right-end boss 16 of the left keyframe-front molding 15A fitted in the fitting hole 17 of the right keyframe-front molding 15B (see FIG. 5B). When the keyframe-front moldings 15A and 15B contract in this state, a distance $\alpha$ between the pin holes 15*a* and 15*a* of each of the keyframe-front moldings 15A and 15B is slightly reduced to a distance $\beta$ which is approximately equal to the distance $\alpha$ (see FIG. 5C).

Figure 5F:
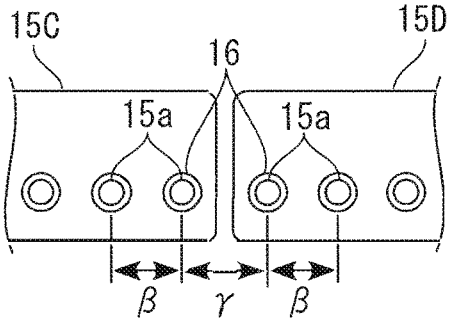

On the other hand, FIGS. 5D to 5F schematically show contraction of the keyframe front 11 in a state in which keyframe-front moldings 15C and 15D in a comparative example have been held in contact with each other and fastened to the front rail 9*a* with screws. The two keyframe-front moldings 15C and 15D shown in FIG. 5D have respective mutually opposed end faces thereof brought into contact with each other (see FIG. 5E). In this case, the distance between the pin holes 15*a* and 15*a* of the respective keyframe-front moldings 15C and 15D, which are closest to each other, is set to the distance $\alpha$ similarly to the distance between the other adjacent two pin holes 15*a*. When the keyframe-front moldings 15C and 15D contract in this state, the distance between the pin holes 15*a* and 15*a* of each of the keyframe-front moldings 15C and 15D is reduced to the distance $\beta$ similarly to the keyframe-front moldings 15A and 15B in the present embodiment. However, the distance between the closest pin holes 15*a* of the respective keyframe-front moldings 15C and 15D is increased to a distance $\gamma$ ($>\alpha$, $\beta$). In this case, a larger gap is formed between two keys 2 and 2 each engaged with an associated one of the front pins 14 on the ends of the respective keyframe-front moldings 15C and 15D and adjacent to each other than between the other adjacent keys 2.

As described above, the connection structure for connecting the keyframe-front moldings 15A and 15B in the present embodiment is distinguished from the connection structure for connecting the keyframe-front moldings 15C and 15D in the comparative example in that even when the keyframe front 11 contracts, it is possible to maintain the distance $\beta$ between the pin holes 15*a* and 15*a* in this state approximately equal to the distance $\alpha$ before the contraction. This makes it possible to prevent occurrence of the problem caused by using the keyframe-front moldings 15C and 15D in the comparative example, more specifically, the problem that a larger gap is formed between the two keys adjacent to each other.

Figure 6:
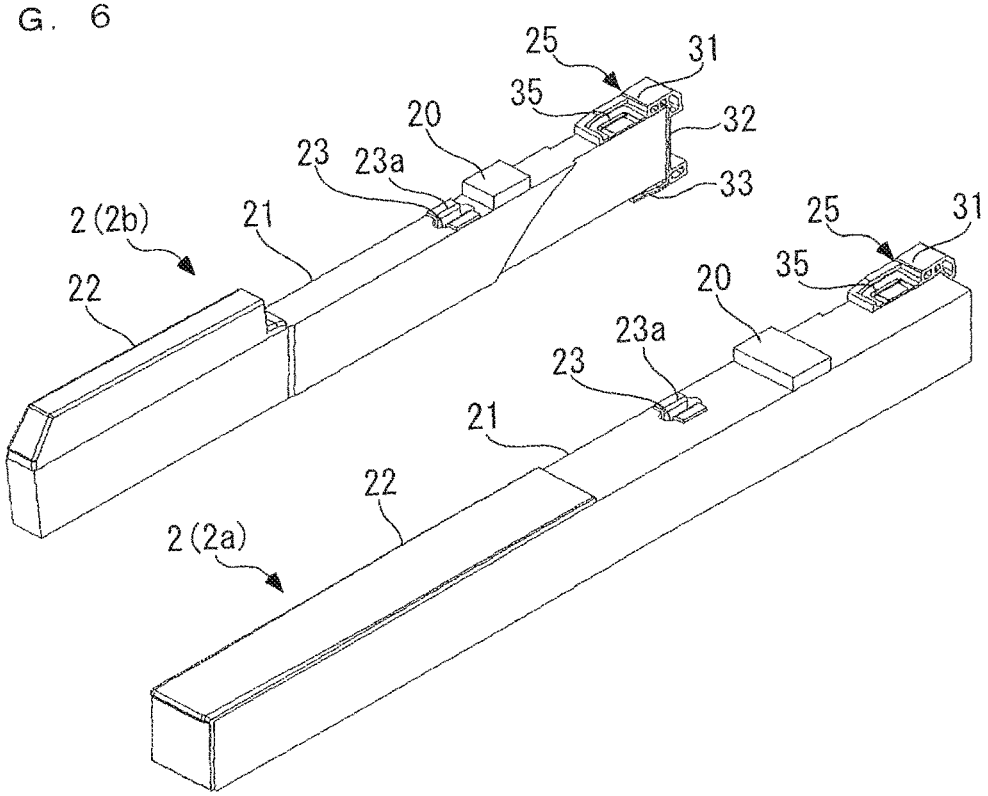
FIG. 6 is a perspective view showing respective examples of a white key and a black key.

FIG. 6 shows a white key 2*a* and a black key 2*b*, As shown in FIG. 6, the key 2 is comprised of a key body 21 made of wood, which has a rectangular cross-section and extends in the front-rear direction, and a key cover 22 made of a synthetic resin, which is bonded to the front and upper surfaces of a front half of the key body 21. In the vicinity of the center of the key body 21 in the longitudinal direction, there is formed a balance pin hole 23, and the key 2 is pivotally supported by the balance pin 13 erected on the keyframe center 12 via the balance pin hole 23.

Note that each of the balance pin holes 23 is comprised of a portion close to the lower surface of the key body 21, which is formed as a substantially circular hole, and a whole upper portion continuous with the circular hole, which is formed as a slot extending in the longitudinal direction of the key body 21. Further, the balance pin hole 23 has left and right inner surfaces each provided with a felt 23*a* so as to enable the balance pin hole 23 to smoothly slide along the balance pin 13 during swinging of the key 2. The key body 21 has a cushion 20 bonded to the upper surface thereof at a location rearward of the balance pin hole 23, and the cushion 20 prevents a front end of the hammer 5 from directly hitting against the key 2 during musical performance or maintenance.

Furthermore, at a predetermined location in a front part of the key body 21, there is formed a front pin hole 24 (see FIG. 2) opening downward, and engagement of the front pin hole 24 with the front pin 14 erected on the keyframe front 11 prevents the key 2 from being laterally displaced during swinging.

Moreover, as shown in FIG. 6, attached to a rear end of each of the white key 2*a* and the black key 2*b* is a hammer contact height-regulating part 25 for regulating a height at which a lower end of a key contact part 56, described hereinafter, of the hammer 5 is held in contact with the key 2 in the key-released state to a predetermined height. The hammer contact height-regulating part 25 is formed by a molded article made of a hard synthetic resin (e.g. an ABS resin) and having a predetermined shape.

Figure 7:
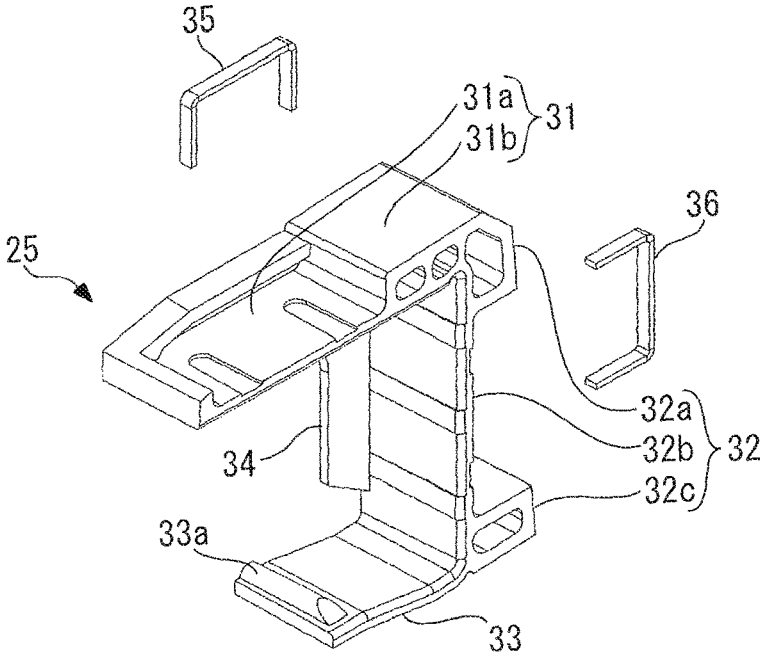
FIG. 7 is a perspective view of a hammer contact height-regulating part mounted on a rear end of the key.
Figure 8A:
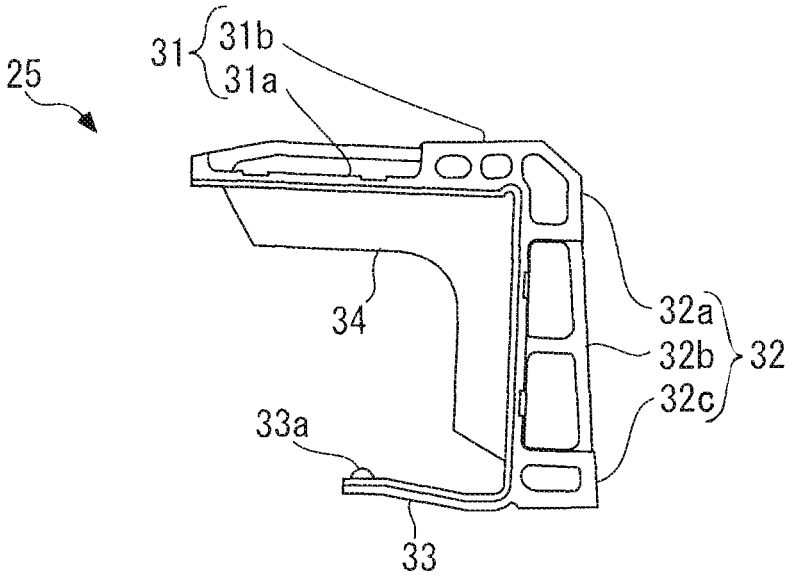
FIG. 8A is a right side view of the hammer contact height-regulating part shown in FIG. 7.
Figure 8B:
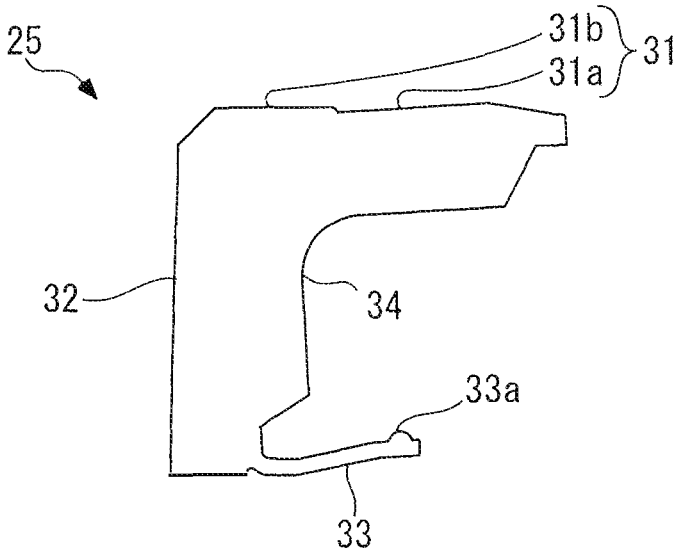
FIG. 8B is a left side view of the hammer contact height-regulating part shown in FIG. 7.

Specifically, as shown in FIGS. 7, 8A, and 8B, the hammer contact height-regulating part 25 has a C-shape in side view, which is formed by an upper piece 31 extending in the front-rear direction over a predetermined length, a rear piece 32 continuous with a rear end of the upper piece 31 and extending downward, and a lower piece 33 continuous with a lower end of the rear piece 32 and extending forward over a predetermined length. Further, the hammer contact height-regulating part 25 has a side wall 34 forming a left side surface thereof and continuous with the upper piece 31 and the rear piece 32.

The upper piece 31 is comprised of an upper piece-securing section 31*a* forming a front half thereof and configured to secure the upper piece 31 itself to a rear end of the upper surface of the key 2, and a hammer-receiving section 31*b* forming a rear half of the upper piece 31 and having a flat upper surface for receiving the key contact part 56 in a state supporting the same from below. The most portion of the upper piece-securing section 31*a* is formed to be thinner than the hammer-receiving section 31*b*, and a C-shaped bracket 35 is driven into the upper piece-securing section 31*a* from outside, whereby the upper piece 31 is secured to the rear end of the upper surface of the key 2.

The rear piece 32 is comprised of a rear-piece upper section 32*a* formed to be continuous with the hammer-receiving section 31*b* of the upper piece 31 and protruding rearward, a rear piece-securing section 32*b* formed to be thinner than the rear-piece upper section 32*a* and extending downward in a state continuous with the rear-piece upper section 32*a*, and a rear-piece lower section 32*c* formed to be continuous with a lower end of the rear piece-securing section 32*b* and protruding rearward. A C-shaped bracket 36 is driven into the rear piece-securing section 32*b* from outside, whereby the rear piece 32 constructed as above is secured to a rear end surface of the key 2.

The lower piece 33 extends forward and obliquely upward from the lower end of the rear piece 32, and a front end of the upper surface of the lower piece 33 has a lower-piece protrusion 33*a* formed thereon for being brought into contact with a rear end of the lower surface of the key 2. The lower piece 33 has resilience that allows the same to bend vertically using a portion thereof connected to the rear piece 32 as a support.

As shown in FIG. 8A, the side wall 34 is formed so as to be continuous with a left end of the lower surface of the upper piece 31 and a left end of the front surface of the rear piece 32 and protrude inward, thereby forming an L-shape in side view. Note that in the hammer contact height-regulating part 25, each of the hammer-receiving section 31*b* of the upper piece 31, and the rear-piece upper section 32*a* and the rear-piece lower section 32*c* of the rear piece 32 is formed with a cavity opening rightward so as to reduce the amount of synthetic resin for molding and the weight of a molded article and prevent sink or deformation in molding.

The hammer contact height-regulating part 25 constructed as above is attached to the rear end of the key 2, with the lower surface of the upper piece 31, the front surface of the rear piece 32, and the side wall 34 held in intimate contact with the upper surface, rear end surface, and left side surface of the rear end of the key 2, respectively, and with the lower-piece protrusion 33*a* of the lower piece 33 held in contact with the rear end of the lower surface of the key 2. Note that in the case of mounting the hammer contact height-regulating part 25 to each key 2, an adhesive is applied to each of the above-mentioned three surfaces of the hammer contact height-regulating part 25, and then the hammer contact height-regulating part 25 is temporarily fixed to the rear end of the key 2. Then, in this state, the two brackets 35 and 36 are driven into the key 2 from above and behind, respectively, whereby the hammer contact height-regulating part 25 is firmly secured to the key 2.

When the key 2 having the hammer contact height-regulating part 25 attached thereto is in its key-released state, as shown in FIG. 2, the rear-piece lower section 32*c* of the hammer contact height-regulating part 25 is placed on a cushion 38 (regulating part-receiving member) secured to the rear rail 9*c*. With this, for all the keys 2 in the key-released state, the hammer-receiving section 31*b* of the hammer contact height-regulating part 25 have the same height.

FIGS. 9A, 9B, 10A, and 10B show the hammer support 4. As shown in FIGS. 9A, 9B, 10A, and 10B, the hammer support 4 is formed by connecting a plurality of molded articles each made of a synthetic resin and provided e.g. for one octave section, to each other in the left-right direction. The hammer support 4 extends over the length of all the hammers 5 in the left-right direction, and is fastened to the rear rail 9*c* of the keyboard chassis 3 with screws. The hammer support 4 is comprised of a hammer supporting part 41 erected from near the rear rail 9*c* and a switch mounting part 42 extending forward and obliquely upward from an upper end of the hammer supporting part 41. In the upper end of the hammer supporting part 41, there are provided hammer support shafts 43 for pivotally supporting the respective hammers 5.

Figure 9A:
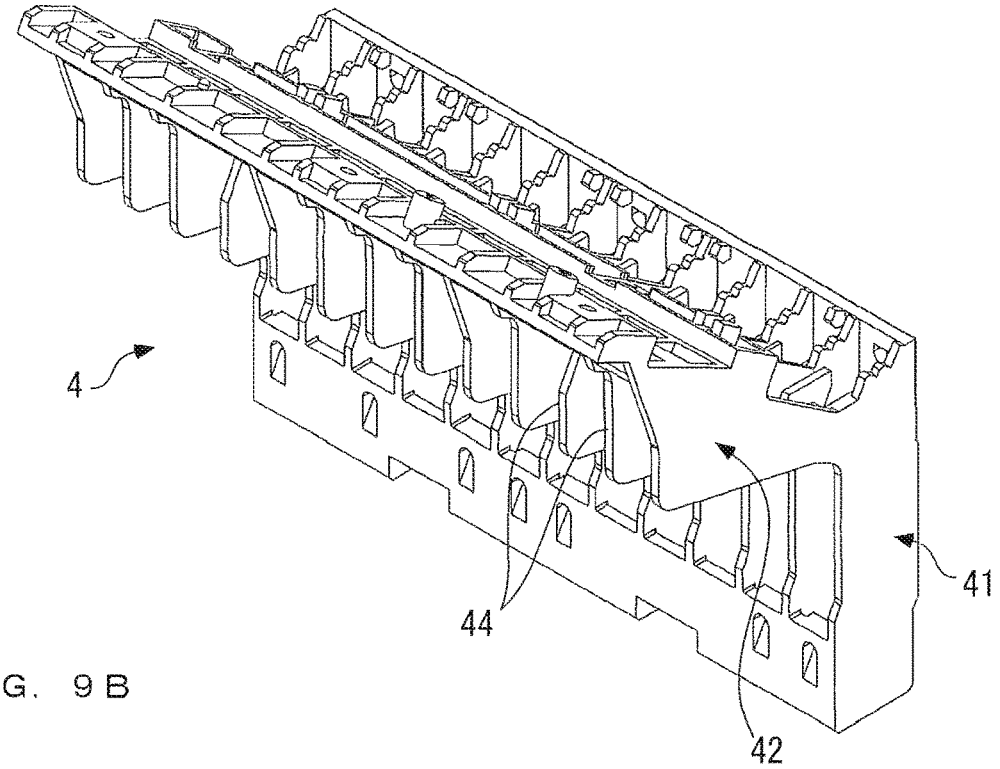
FIG. 9A is a perspective view of the whole of a hammer support for a one-octave section.
Figure 9B:
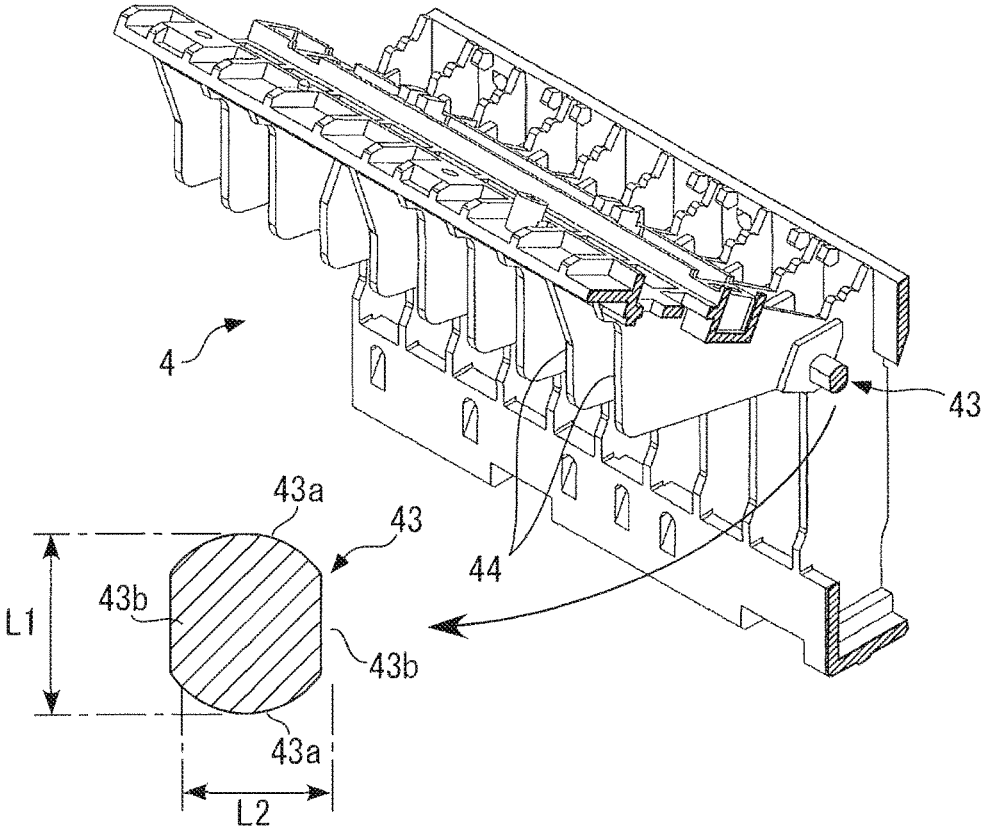
FIG. 9B is a view of the hammer support shown in FIG. 9A in a partially cut-away state, with a cross-section of a hammer support shaft shown on an enlarged scale.
Figure 10A:
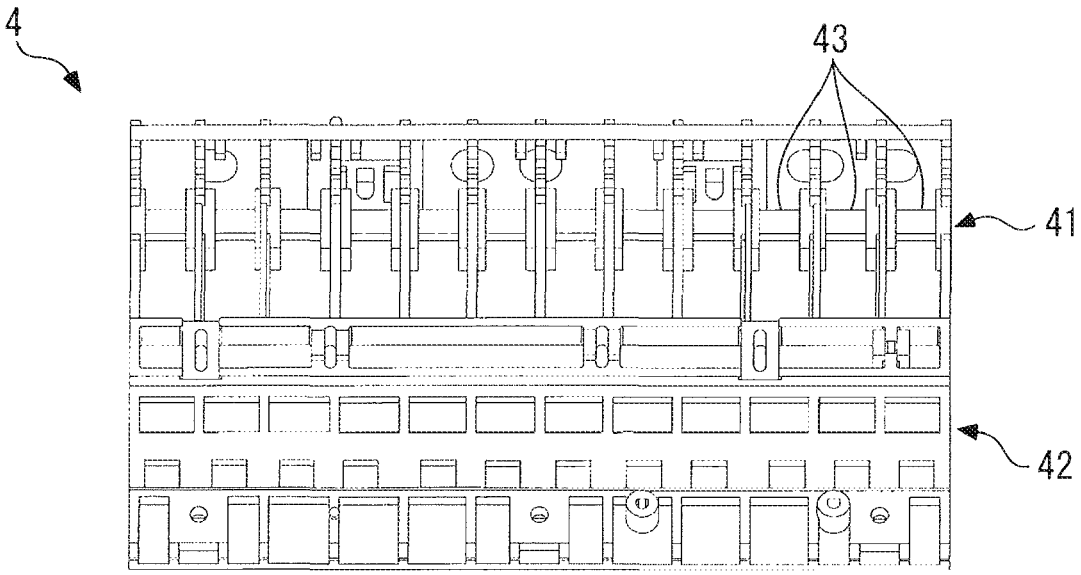
FIG. 10A is a plan view of the hammer support.
Figure 10B:
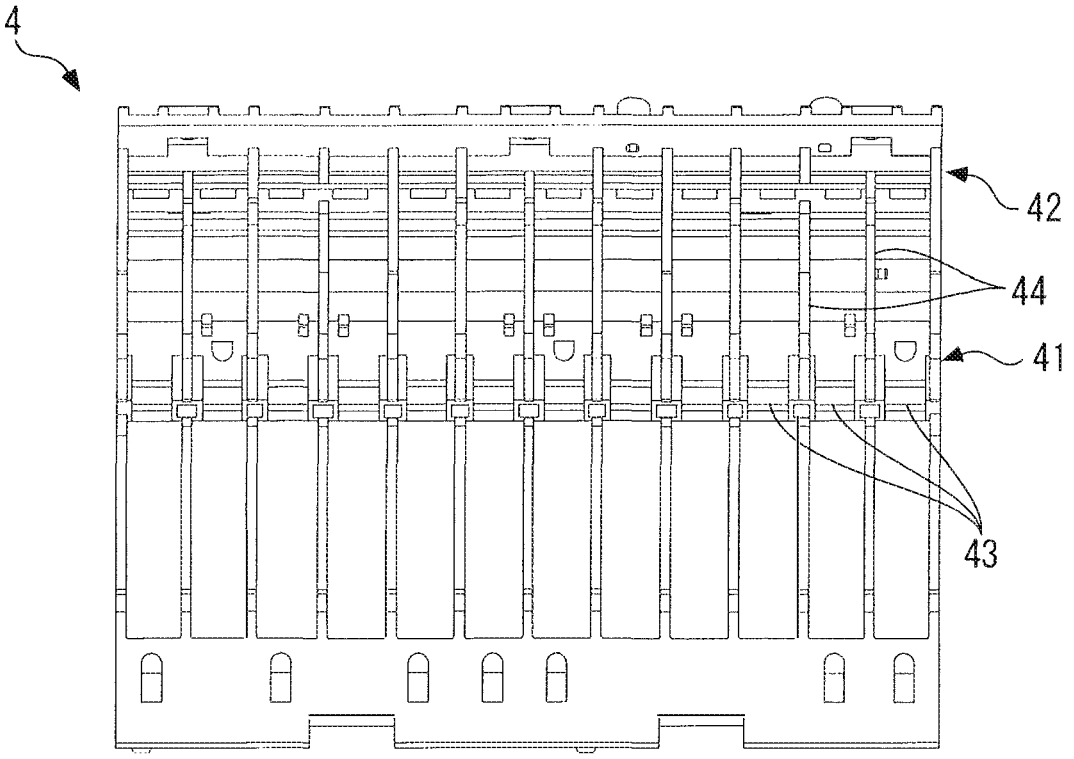
FIG. 10B is a front view of the hammer support.

Further, the hammer support 4 has a plurality of partition walls 44 which are formed with a predetermined spacing therebetween in the left-right direction such that adjacent hammers 5 are separated from each other, and the hammer support shaft 43 extends in the left-right direction through between each pair of adjacent ones of the partition walls 44. The hammer support shaft 43 has a so-called oval cross-section, as shown in FIG. 9B, which is formed by cutting two front and rear portions away from a circle having the axis of the hammer support shaft 43 as its center.

Specifically, the hammer support shaft 43 has an outer peripheral surface formed by a pair of upper and lower arcuately-curved surfaces 43*a* and 43*a* and a pair of front and rear planar surfaces 43*b* and 43*b* extending between the arcuately-curved surfaces 43*a* and 43*a*. In the hammer support shaft 43 constructed as above, the upper and lower arcuately-curved surfaces 43*a* and 43*a* are configured to form, in cross-section, segments of a circle having a diameter of a length L1, and the distance between the front and rear planar surfaces 43*b* and 43*b* is configured to have a length L2 which is shorter than the length L1.

Figure 11:
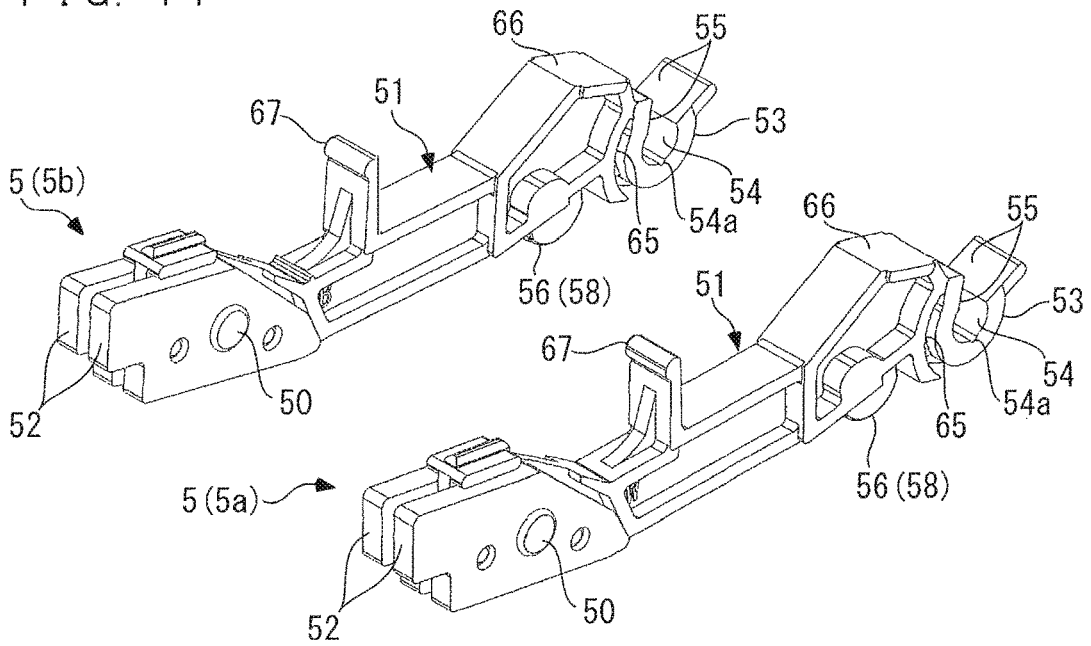
FIG. 11 is a perspective view of a white key-associated hammer and a black key-associated hammer.

FIG. 11 shows a white key-associated hammer 5 (5*a*) and a black key-associated hammer 5 (5*b*). As shown in FIG. 11, the white key-associated hammer 5*a* and the black key-associated hammer 5*b* basically have the same construction as a whole, and therefore the following description will be given, by taking the white key-associated hammer 5 (5*a*) as a representative of the two hammers 5*a* and 5*b*.

Figure 12A:
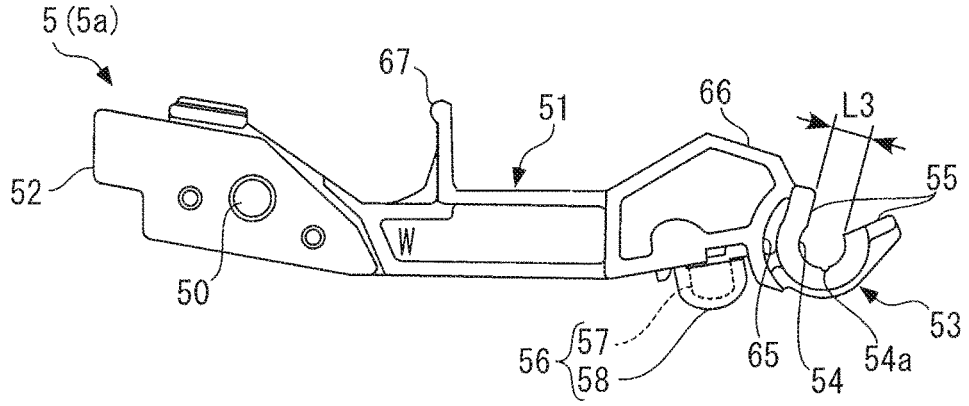

As shown in FIGS. 11 and 12A, the hammer 5 is comprised of an arm-like hammer body 51 extending in the front-rear direction and two weight plates 52 and 52 attached to front ends of respective left and right side surfaces of the hammer body 51 with a rivet 50. The hammer body 51 is made of a hard synthetic resin, while each of the weight plates 52 and 52 is made of a metal material, such as a ferrous material, having a relatively high specific gravity. Note that the white key-associated hammer body 51 and the black key-associated hammer body 51 have their respective side surfaces inscribed with uppercase alphabetic characters "W" and "B", respectively.

The hammer body 51 has an engaging part 53 formed on a rear end thereof, for engagement with the hammer support shaft 43 of the hammer support 4. In the engaging part 53, there is formed an arcuate shaft hole 54 having a C-shape in side view, and front and rear guide surfaces 55 and 55 are provided at the opening of the shaft hole 54 such that they extend outward therefrom to expand from each other. The shaft hole 54 has a diameter slightly larger than the diameter (length L1) of the circle formed by the upper and lower arcuately-curved surfaces 43*a* and 43*a* of the hammer support shaft 43, and the opening has a width L3 which is set to be slightly larger than the length L2 between the front and rear planar surfaces 43*b* and 43*b* of the hammer support shaft 43 and smaller than the length L1. The hammer 5 is removably attached to the hammer support shaft 43 of the hammer support 4 via the opening of the shaft hole 54, and the shaft hole 54 is fitted on the hammer support shaft 43, whereby the hammer 5 is pivotally supported by the hammer support 4.

Further, as shown in FIG. 12A, at a predetermined location on the rear of a bottom surface of the hammer 5, there is provided a key contact part 56 (protrusion) that protrudes downward for contact with the hammer contact height-regulating part 25 of the key 2 from above. The key contact part 56 is comprised of a contact protrusion 57 integrally formed with the hammer body 51 of the hammer 5, and a protrusion cover 58 mounted on the hammer body 51 so as to cover the contact protrusion 57.

Figure 12B:
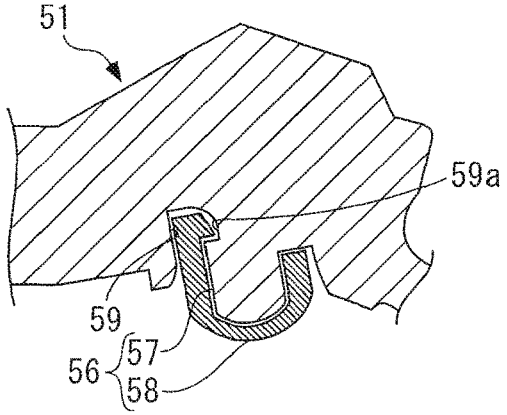

As shown in FIG. 12B, the contact protrusion 57 of the key contact part 56 protrudes downward and has a lower surface formed in an arcuate shape in cross-section. Further, the hammer body 51 has a hook-receiving part 59 formed in a front-side upper portion of the contact protrusion 57, for engagement with a hook 62, described hereinafter, of the protrusion cover 58. The hook-receiving part 59 is formed in a recessed shape opening downward, and has a latching recess 59*a* in an upper end of the recessed shape.

Figure 12C:
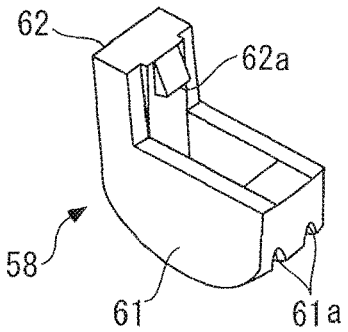

On the other hand, the protrusion cover 58 is formed by a molded article made of a predetermined elastic material (e.g. elastomer) and having a predetermined shape. Specifically, as shown in FIGS. 12B and 12C, the protrusion cover 58 is comprised of an upwardly open cover body 61 for accommodating the contact protrusion 57 in a state covering the same, and the hook 62 extending upward from a front end of the cover body 61 for engagement with the hook-receiving part 59. Similar to the contact protrusion 57 of the hammer body 51, the cover body 61 has a bottom surface thereof formed in an arcuate shape in cross-section. Further, the hook 62 has an upper end formed with a lug 62*a*, and the lug 62*a* is engaged with the latching recess 59*a* of the hook-receiving part 59, whereby the protrusion cover 58 is securely attached to the hammer body 51 in a state mounted on the contact protrusion 57.

Note that in the bottom surface of the protrusion cover 58, there are formed two grooves 61*a* and 61*a* extending parallel to each other and opening downward (see FIG. 12C). These grooves 61*a* serve to hold, over a long time period, low-viscosity lubricant applied to the bottom surface of the protrusion cover 58, and the lubricant considerably reduces friction between the key contact part 56 and the hammer-receiving section 31*b* of the hammer contact height-regulating part 25, thereby improving lubricity between the two.

Further, in the hammer 5, a relatively high-viscosity lubricant, such as grease, is applied between the shaft hole 54 and the hammer support shaft 43 of the hammer support 4. This makes it possible to ensure smooth pivotal motion of the hammer 5 while preventing the hammer 5 from causing rattling and noise during pivotal motion.

However, the above-mentioned lubricant can spill out from between the shaft hole 54 of the hammer 5 and the hammer support shaft 43 e.g. due to an environment under which the electronic piano is used. When the spilled lubricant flows along the side surfaces of the hammer 5 and sticks to the key contact part 56 located forward of the shaft hole 54, or more specifically, when the spilled lubricant sticks to the key contact part 56 having a lubricating oil already applied thereto, the characteristics of the lubricating oil and the lubricant change, which causes a change in the friction between the key contact part 56 of the hammer 5 and the hammer contact height-regulating part 25 (hammer-receiving section 31*b*) of the key 2, resulting in a change in the pivoting characteristics of the hammer 5 in key depression. In order to avoid this problem, the left and right side surfaces of the hammer body 51 are provided with two respective left and right lubricant-blocking portions 65 (only the right one of which is shown in FIGS. 11 and 12A), which are formed at a location immediately forward of the engaging part 53 in the rear end and rearward of the key contact part 56 in bilaterally symmetrical relation to each other. Each of the lubricant-blocking portions 65 is formed in an arcuate shape surrounding the engaging part 53 and in a recessed shape opening in a lateral direction of the hammer body 51.

The lubricant-blocking portions 65 are formed on the respective left and right side surfaces of the hammer body 51, as described above, whereby even when lubricant spilled from the engaging part 53 flows along the side surfaces of the hammer body 51, it is possible to effectively prevent the lubricant from flowing across the lubricant-blocking portions 65 having the recessed shape.

Further, as shown in FIGS. 11 and 12A, in the hammer body 51, there is provided an actuator part 66 for pressing and actuating the key switch 7 during key depression at a location forward and upward of the engaging part 53 of the rear end. Furthermore, the hammer body 51 has a plate-like engaging protrusion 67 protruding from the upper surface thereof at a location close to the longitudinal center thereof for engagement with the let-off member 6 during key depression.

As shown in FIG. 2, the let-off member 6, which is formed by a molded article of a predetermined elastic material, is mounted on the switch-mounting part 42 of the hammer support 4. The let-off member 6 extends obliquely and downwardly rearward from the switch-mounting part 42, and a head part 6*a* is formed on a tip end of the let-off member 6 by way of a neck part. In the key-released state, the head part 6*a* is opposed to the engaging protrusion 67 of the hammer 5.

Further, as shown in FIGS. 1 and 2, the key switch 7 is comprised of a switch board 7*a* formed by a printed circuit board and switch bodies 7*b* each formed by a rubber switch provided on the lower surface of the switch board 7*a* for an associated one of the keys 2. The switch board 7*a* has a rear end inserted into the switch-mounting part 42 of the hammer support 4, and a central portion fastened to the switch-mounting part 42 with screws. In the key-released state, the switch body 7*b* is opposed to the actuator part 66 of the hammer 5 with a spacing therebetween.

Furthermore, as shown in FIGS. 1 and 2, on the bottom surface of the switch-mounting part 42 of the hammer support 4, there is provided a hammer stopper 68 for restricting upward pivotal motion of the hammer 5. The hammer stopper 68 is formed e.g. of foamed urethane and mounted on the switch-mounting part 42 such that the hammer stopper 68 extends in the left-right direction.

Figure 13A:
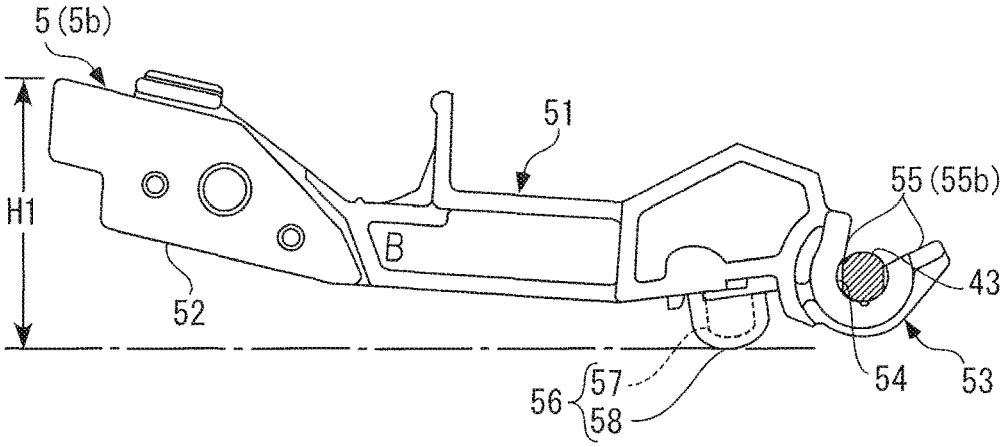
Figure 13B:
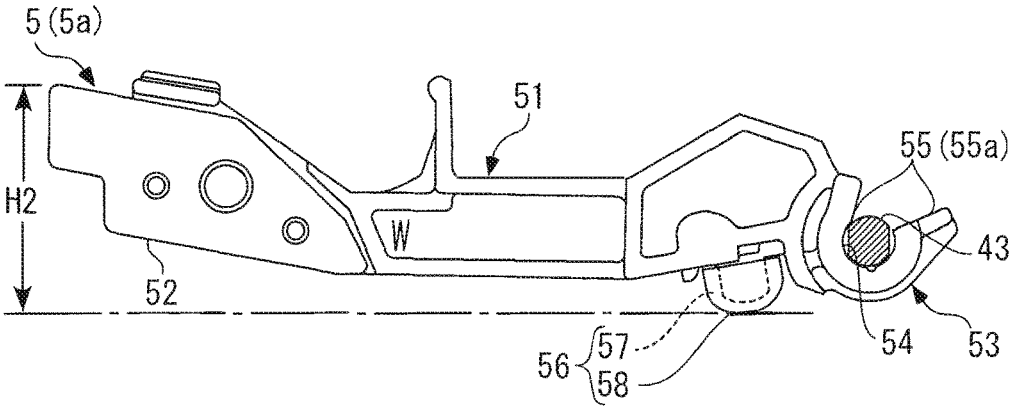

Now, a description will be given, with reference to FIGS. 13A to 13C, 14A, and 14B, of different points between the white key-associated hammer 5*a* and the black key-associated hammer 5*b* in the above-described keyboard device 1. FIGS. 13A and 13B show the black key-associated hammer 5*b* and the white key-associated hammer 5*a*, respectively, in the key-released state. As shown in FIGS. 13A and 13B, when attention is paid to a relation (height) between the lower end of the key contact part 56 of the hammer 5 and the upper end of the weight plate 52 in the front end of the hammer 5, a height H1 of the black key-associated hammer 5*b* is higher than a height H2 of the white key-associated hammer 5*a* by a predetermined height, in the key-released state. With this, in the case of the hammer 5, which is pivotally moved in accordance with key depression and is brought into abutment with the hammer stopper 68, an angle of pivotal motion of the black key-associated hammer 5*b* becomes smaller than that of the white key-associated hammer 5*a*, and as a consequence, the key depression stroke of the black key 2*b* (e.g. 9 mm) becomes shorter than that of the white key 2*a* (e.g. 10 mm).

Figure 13C:
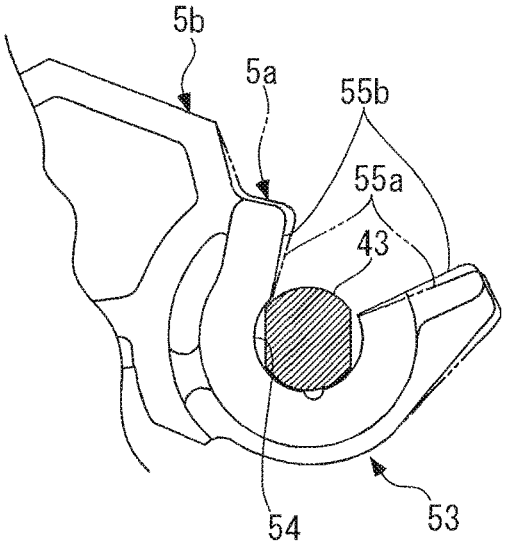

FIG. 13C shows, on an enlarged scale, the hammer support shaft 43 of the hammer support 4 and the engaging parts 53 in the respective rear ends of the black key-associated hammer 5*b* (indicated by solid lines) and the white key-associated hammer 5*a* (indicated by a two-dot chain line), in the key-released state. As shown in FIG. 13C, the front and rear guide surfaces 55*a* and 55*a* formed at the opening of the shaft hole 54 of the white key-associated hammer 5*a* such that they extend outward therefrom to expand from each other are slightly inclined clockwise, as viewed in FIG. 13C, with respect to the guide surfaces 55*b* and 55*b* of the black key-associated hammer 5*b*, Since the guide surfaces 55*b* are different in inclination from the guide surfaces 55*a* as described above, an angle at which the hammer 5 is removed from the hammer support 4 is different between the black key-associated hammer 5*b* and the white key-associated hammer 5*a*, as described below. Note that the hammer 5 is removed in a state in which the associated key 2 has been removed from the keyboard chassis 3.

Figure 14A:
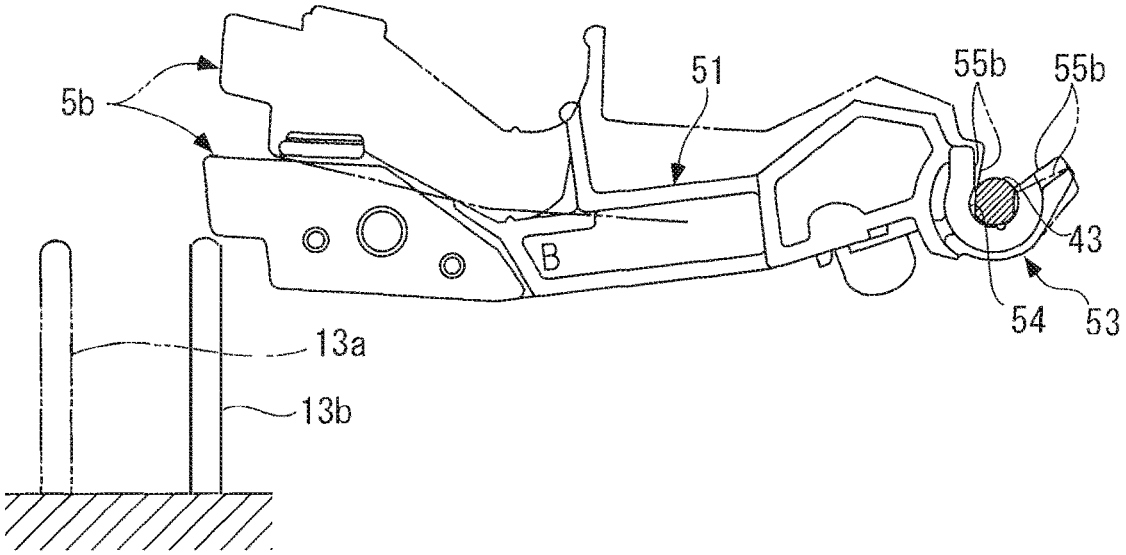
Figure 14B:
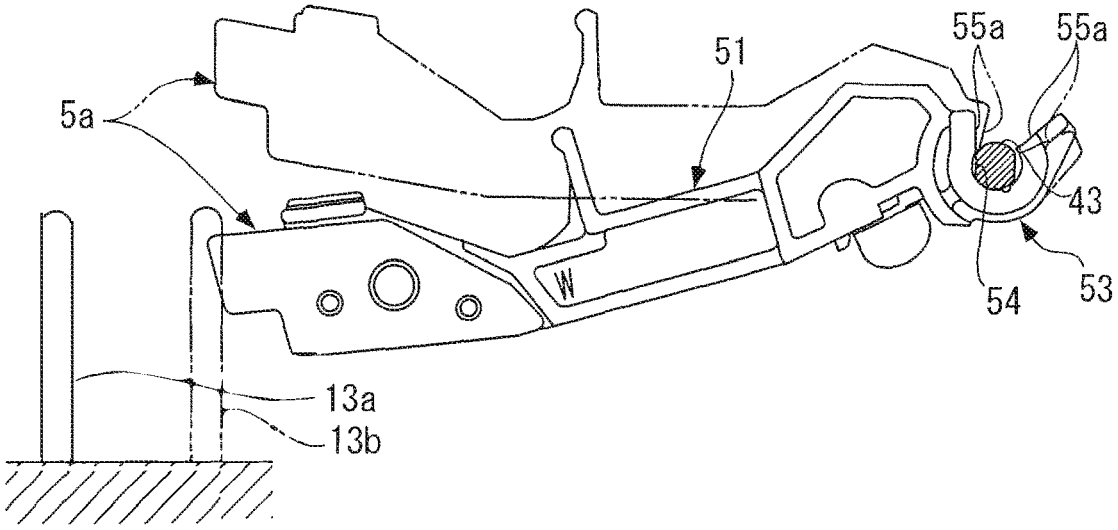

FIGS. 14A and 14B show the black key-associated hammer 5*b* and the white key-associated hammer 5*a*, respectively, each in a state immediately before being removed from the hammer support shaft 43 of the hammer support 4. Note that each of the black key-associated hammer 5*b* and the white key-associated hammer 5*a* each indicated by two-dot chain lines in FIG. 14A or 14B is in its key-released position. As shown in FIG. 14A, when the black key-associated hammer 5*b* is pivotally moved from the key-released position such that the front end thereof reaches close to the upper end of the black key-associated balance pin 13*b*, the front guide surface 55*b* of the engaging part 53 in the rear end becomes vertical, i.e. parallel to the front planar surface 43*b* of the hammer support shaft 43, and contact between the shaft hole 54 of the black key-associated hammer 5*b* and the upper arcuately-curved surface 43*a* of the hammer support shaft 43 of the hammer support 4 is released, which makes it possible to remove the black key-associated hammer 5*b* from the hammer support shaft 43.

On the other hand, as shown in FIG. 14B, the white key-associated balance pin 13*a* for supporting the white key 2*a* associated with the white key-associated hammer 5*a* is located forward of the black key-associated balance pin 13*b*, For this reason, even when the white key-associated hammer 5*a* is pivotally moved downward largely to a position lower than the upper end of the black key-associated balance pin 13*b*, the white key-associated hammer 5*a* does not interfere with the white key-associated balance pin 13*a*. Further, the guide surfaces 55*a* in the rear end of the white key-associated hammer 5*a* and the guide surfaces 55*b* of the black key-associated hammer 5*b* are different in inclination as described hereinbefore, so that when the white key-associated hammer 5*a* is pivotally moved downward largely to a lower position than the black key-associated hammer 5*b* is pivotally moved, the front guide surface 55*a* in the rear end becomes vertical, i.e. parallel to the front planar surface 43*b* of the hammer support shaft 43, which makes it possible to remove the white key-associated hammer 5*a* from the hammer support shaft 43, similarly to the case of the black key-associated hammer 5*b*.

As described above, the white key-associated hammer 5*a* can be removed from the hammer support shaft 43 in a state pivotally moved downward more largely than the black key-associated hammer 5*b*, In other words, in the case of the white key-associated hammer 5*a*, the engaging part 53 in the rear end is engaged with the hammer support shaft 43 in a state unremovable in a larger angle range than in the case of the black key-associated hammer 5*b*, For this reason, although the front end of the white key-associated hammer 5*a* is positioned lower than that of the black key-associated hammer 5*b* in the key-released state, the white key-associated hammer 5*a* is securely engaged with the hammer support shaft 43 as is the case with the black key-associated hammer 5*b*, so that it is possible not only to effectively prevent the white key-associated hammer 5*a* from causing rattling and noise during pivotal motion, but also to enhance the degree of freedom in design of the white key-associated hammer 5*a*.

Next, a description will be given of the operation of the keyboard device 1 constructed as above. When the key 2 is depressed in the key-released state shown in FIGS. 1 and 2, the key 2 pivotally moves about the balance pin 13 in the counterclockwise direction as viewed in FIG. 2, and in accordance with this pivotal motion of the key 2, the hammer 5 is pushed up via the key contact part 56 to pivotally move upward (clockwise, as viewed in FIG. 2) about the hammer support shaft 43.

During the pivotal motion of the hammer 5, the engaging protrusion 67 is brought into engagement with the head part 6*a* of the let-off member 6 to press the let-off member 6 while compressing the same via the head part 6*a*, whereby reaction force acting on the hammer 5 from the let-off member 6 is increased. When the hammer 5 further pivotally moves, the engaging protrusion 67 is disengaged from the head part 6*a*, causing the reaction force from the let-off member 6 to disappear abruptly. The increase and disappearance of the reaction force from the let-off member 6 provides let-off feeling closely analogous to let-off feeling provided by an acoustic piano.

Then, when the front end of the hammer 5 comes into abutment with the hammer stopper 68 disposed above, the upward pivotal motion of the hammer 5 is terminated. During the upward pivotal motion of the hammer 5, the actuator part 66 presses the switch body 7*b* of the key switch 7 to turn on the key switch 7, whereby key depression information on the key 2 corresponding to the amount of pivotal motion of the hammer 5 is detected and output to a tone generation controller (not shown). Tone generation of the electronic piano is controlled by the tone generation controller, based on the detected key depression information.

Thereafter, when the key 2 is released, the key 2 pivotally moves in a direction reverse to the direction in which the key 2 is pivotally moved during key depression, and returns to the key-released state shown in FIGS. 1 and 2. In accordance with this motion of the key 2, the hammer 5 pivotally moves downward and returns to its key-released state.

As described above in detail, according to the present embodiment, the hammer contact height-regulating part 25 made of a synthetic resin is provided in the rear end of the key 2, and in the key-released state, the hammer 5 is placed on the hammer-receiving section 31*b* of the hammer contact height-regulating part 25 in a state in contact with the same from above via the key contact part 56 protruding downward. In this case, the hammer contact height-regulating part 25 constantly holds the hammer-receiving section 31*b* at the same height, so that differently from the conventional art, it is not required to provide a capstan screw. Therefore, in the present embodiment, the conventional capstan screw can be omitted, which makes it possible to dispense with work for mounting and adjusting the capstan screw, and contributes to reduction of the manufacturing costs of the electronic piano.

Further, in the key-released state, the rear-piece lower section 32*c* of the hammer contact height-regulating part 25 of each of all the keys 2 is placed on the cushion 38 on the rear rail 9. In this case, even when there are vertical thickness variations between the rear ends of the respective keys 2, the height of the hammer-receiving section 31*b* of the hammer contact height-regulating part 25 of each key 2 in the key-released state is determined by a state of the hammer contact height-regulating part 25 placed on the cushion 38. Therefore, by providing the hammer contact height-regulating part 25 in the rear end of each of the keys 2, it is possible to set the hammer-receiving sections 31*b* of all the hammer contact height-regulating parts 25 at a uniform predetermined height while accommodating thickness variations in the rear ends of the respective keys 2.

Further, in the hammer 5, the key contact part 56 is formed by mounting the protrusion cover 58 made of an elastic material on the contact protrusion 57 of the hammer body 51, so that even when the key contact part 56 of the hammer 5 comes into contact with or slides over the hammer-receiving section 31*b* of the hammer contact height-regulating part 25 again after temporarily moving away from the same during key depression, it is possible to sufficiently suppress generation of noise on such an occasion. Furthermore, the protrusion cover 58 is securely mounted on the hammer body 51 via the hook 62, so that even when the hammer 5 is repeatedly pushed up in accordance with key depression, the protrusion cover 58 does not come off the contact protrusion 57. Moreover, the protrusion cover 58 can be easily removed from the hammer body 51, which makes it possible to easily replace the protrusion cover 58 with a new one as required.

Further, the hook-receiving part 59 opening downward from the hammer body 51 is provided in the hammer body 51 at a location forward and upward of the contact protrusion 57. This makes it possible to reduce stress acting on a portion of the hammer body 51 in the vicinity of the base part of the contact protrusion 57 during key depression in comparison with a case where the hook-receiving part 59 is provided in the hammer body 51 e.g. at a location rearward and upward of the contact protrusion 57, more specifically, at a location closer to a support about which the hammer 5 pivotally moves. As a consequence, even when the hammer 5 is repeatedly pushed up in accordance with key depression, it is possible to prevent the hammer 5 (hammer body 51) from being damaged.

What is more, in the hammer 5, each of the left and right side surfaces of the hammer body 51 is formed with the lubricant-blocking portion 65 in the recessed shape opening laterally, which makes it possible to prevent lubricant applied between the shaft hole 54 of the hammer 5 and the hammer support shaft 43 of the hammer support 4 from spilling to the key contact part 56 located forward of the lubricant-blocking portions 65. This makes it possible to prevent the friction between the key contact part 56 of the hammer 5 and the hammer-receiving section 31*b* of the hammer contact height-regulating part 25 for contact with the key contact part 56 from being changed, and as a consequence, it is possible to maintain excellent pivoting characteristics of the hammer 5 in key depression.

Note that the present invention is not limited to the above-described embodiment, but can be practiced in various forms. For example, although in the above-described embodiment, the protrusion cover 58 made of an elastic material is mounted on the contact protrusion 57 of the hammer body 51, the protrusion cover 58 may be omitted in a case where it is possible to prevent generation of noise and maintain sufficient slidability between the contact protrusion 57 and the hammer-receiving section 31*b* of the hammer contact height-regulating part 25 during key depression, or alternatively, a member made of an elastic material may be disposed on the hammer-receiving section 31*b* of the hammer contact height-regulating part 25.

Further, the details of the construction of the keyboard device 1, the key 2, or the hammer 5 described in the embodiment are given only by way of example, and various changes and modifications may be made without departing from the spirit and scope of the present invention.

What is claimed is:

1. A keyboard device for an electronic keyboard instrument, comprising:

a plurality of keys made of wood, each extending in a front-rear direction and configured to be capable of swinging about a support close to a center thereof in the front-rear direction, the keys being arranged in a state juxtaposed in a left-right direction;

a hammer support disposed rearward of the keys;

a plurality of hammers each extending in the front-rear direction, the plurality of hammers each having a rear end thereof supported by the hammer support pivotally movably in a vertical direction, and a protrusion protruding downward from a lower surface thereof brought into contact with a rear end of an associated one of the keys; and a plurality of hammer contact height-regulating parts, each having a predetermined vertical size and made of a synthetic resin and mounted on the rear end of the associated one of the keys in contact with an upper surface and a lower surface of the associated one of the keys, and being in contact with the protrusion of an associated one of the hammers in a key-released state to regulate a contact height of the protrusion of the associated one of the hammers to a predetermined height by the predetermined vertical size.

2. The keyboard device according to claim 1, further comprising a regulating part-receiving member which is disposed to extend in the left-right direction in association with the keys, and on which the hammer contact height-regulating parts are placed at the same height in a key-released state.

3. The keyboard device according to claim 2, wherein each of the plurality of hammer contact height-regulating parts includes:

an upper piece secured to an upper surface of the associated one of the keys and held in contact with the protrusion of the associated one of the hammers, and a rear piece extending downward continuously from a rear end of the upper piece and secured to a rear surface of the associated one of the keys.

4. The keyboard device according to claim 3, wherein each of the plurality of hammer contact height-regulating parts further includes a side wall continuous with respective sides of the upper piece and the rear piece and held in intimate contact with a side surface of the associated one of the keys.

5. The keyboard device according to claim 3, wherein the hammer contact height-regulating part further includes a lower piece extending forward from a lower end of the rear piece and being in contact with a lower surface of the associated one of the keys.

6. The keyboard device according to claim 3, wherein each of the upper piece and the rear piece of a hammer contact height-regulating part is secured to the associated one of the keys via a bracket.

7. A hammer device for an electronic keyboard instrument including a key extending in a front-rear direction and configured to be capable of swinging about a portion close to a center thereof, wherein the hammer device includes a hammer which is placed on a rear end of the key and pivotally moves by being pushed up by the key when the key is depressed, the hammer device comprising:

a hammer body made of a synthetic resin, which extends in the front-rear direction and is supported such that the hammer body is pivotally movable in a vertical direction about a support in a rear end thereof; and a contact protrusion integrally formed with the hammer body at a predetermined location forward of the support in a state protruding downward, the contract protrusion being in contact with the rear end of the key from above in a key-released state.

8. The hammer device according to claim 7, further comprising a protrusion cover made of an elastic material and mounted on the hammer body in a state covering the contact protrusion.

9. The hammer device according to claim 8, wherein the protrusion cover includes a cover body which opens upward and accommodates the contact protrusion, and a hook provided such that the hook protrudes upward from the cover body, and wherein the hammer body has a hook-receiving part formed in a recessed shape opening downward for engagement with the hook in a state preventing the hook from coming off.

10. The hammer device according to claim 9, wherein the hook-receiving part is formed in the hammer body at a predetermined location forward of the contact protrusion.

11. A hammer device for an electronic keyboard instrument including a key extending in a front-rear direction and configured to be capable of swinging about a portion close to a center thereof, wherein the hammer device includes a hammer which is placed on a rear end of the key and pivotally moves by being pushed up by the key when the key is depressed, the hammer device comprising:

a hammer support disposed rearward of the key;

a hammer body made of a synthetic resin, which extends in the front-rear direction and has an engaging part of a rear end thereof being engaged with the hammer support, for being supported thereon and pivotally movably in a vertical direction;

a key contact part provided on the hammer body at a predetermined location forward of the engaging part such that the key contact part protrudes downward, the key contact part being in contact with the rear end of the key from above in a key-released state; and a lubricant-blocking portion provided in a side surface of the hammer body so as to prevent a lubricant applied to the engaging part from spilling out to the key contact part.

12. The hammer device according to claim 11, wherein the lubricant-blocking portion is formed in an arcuate shape surrounding the engaging part.

13. The hammer device according to claim 12, wherein the lubricant-blocking portion is formed in a recessed shape opening in a lateral direction of the hammer body.

* * * * *